US011913748B2

(12) United States Patent
Rainaud et al.

(10) Patent No.: US 11,913,748 B2
(45) Date of Patent: Feb. 27, 2024

(54) MAGAZINE FOR RIMMED AMMUNITION

(71) Applicant: Sig Sauer, Inc., Newington, NH (US)

(72) Inventors: Tyler Rainaud, Nottingham, NH (US); Matthew A. Taylor, Barrington, NH (US)

(73) Assignee: Sig Sauer, Inc., Newington, NH (US)

( * ) Notice: Subject to any disclaimer, the term of this patent is extended or adjusted under 35 U.S.C. 154(b) by 0 days.

(21) Appl. No.: 17/699,602

(22) Filed: Mar. 21, 2022

(65) Prior Publication Data

US 2023/0296339 A1 Sep. 21, 2023

(51) Int. Cl.
*F41A 9/69* (2006.01)
*F41A 9/70* (2006.01)

(52) U.S. Cl.
CPC . *F41A 9/69* (2013.01); *F41A 9/70* (2013.01)

(58) Field of Classification Search
CPC ..... F41A 9/69; F41A 9/70; F41A 9/65
USPC ..... 42/50
See application file for complete search history.

(56) References Cited

U.S. PATENT DOCUMENTS 1,245,499 A 11/1917 Orme
1,833,862 A 11/1931 Hugo
2,396,816 A 3/1946 Boudreau
3,399,480 A 9/1968 Rowe, Jr.
3,619,929 A * 11/1971 Fremont ..... F41A 9/69 42/50
D241,837 S 10/1976 Sofinowski
4,107,862 A * 8/1978 Sofinowski, III ..... F41A 9/65 42/50
4,495,720 A 1/1985 Bross
4,502,237 A 3/1985 Krogh
4,589,218 A 5/1986 Teppa
4,862,619 A 9/1989 Baldu et al.
(Continued)

FOREIGN PATENT DOCUMENTS

CN 2938003 Y 8/2007
EP 2336705 A1 6/2011
(Continued)

OTHER PUBLICATIONS

Sig Sauer, Inc., P228, P229 10rd 9mm Magazine, available at https://www.sigsauer.com/store/p228-p229-10rd-9mm-magazine.html> (2019).

(Continued)

*Primary Examiner* — Reginald S Tillman, Jr.
(74) *Attorney, Agent, or Firm* — Finch & Maloney PLLC

(57) ABSTRACT

A magazine for rimmed cartridges includes a magazine tube having first left and right ribs on an inside of the magazine tube extend inward from a forward portion of opposite sidewalls and are laterally spaced by a first spacing. Second left and right ribs on an inside of the magazine tube extend inward from a rear portion of opposite sidewalls and are laterally spaced by a second spacing that is greater than the first spacing. When the magazine is filled to capacity with rimmed cartridges, cartridges in the magazine are arranged in two offset columns with projectiles of the rimmed cartridges laterally spaced from a median plane by a first distance and rims of the rimmed cartridges laterally spaced from the median plane by a second distance that is greater than the first distance. Also disclosed is a baseplate that attaches to a magazine tube using a snap fit.

20 Claims, 10 Drawing Sheets

(56) References Cited

U.S. PATENT DOCUMENTS

| | | | |
|---|---|---|---|
| 4,888,899 | A | 12/1989 | Chestnut et al. |
| D309,768 | S | 8/1990 | Bloackshaw |
| 5,099,595 | A | 3/1992 | Chestnut |
| 5,309,660 | A | 5/1994 | Blackamore |
| 5,357,703 | A | 10/1994 | Chestnut |
| 5,438,783 | A | 8/1995 | Sniezak |
| D362,044 | S | 9/1995 | Sniezak |
| 5,461,811 | A | 10/1995 | Ciener |
| 5,666,752 | A | 9/1997 | Grams |
| 6,401,379 | B1 | 6/2002 | Moon |
| 6,568,115 | B2 | 5/2003 | Beretta |
| 7,117,622 | B2 | 10/2006 | Freed et al. |
| D598,065 | S | 8/2009 | Vukovic et al. |
| D614,720 | S | 4/2010 | Fitzpatrick et al. |
| D614,721 | S | 4/2010 | Fitzpatrick et al. |
| D616,057 | S | 5/2010 | Fitzpatrick et al. |
| D620,544 | S | 7/2010 | Fitzpatrick et al. |
| D620,545 | S | 7/2010 | Fitzpatrick et al. |
| D642,234 | S | 7/2011 | Marfione |
| D645,112 | S | 9/2011 | Sullivan et al. |
| D654,978 | S | 2/2012 | Karanian et al. |
| D670,350 | S | 11/2012 | Emde |
| D670,784 | S | 11/2012 | Emde |
| 8,365,454 | B2 | 2/2013 | Hogan, Jr. |
| 8,371,058 | B2 | 2/2013 | Trpcic |
| D681,131 | S | 4/2013 | Su |
| 8,448,364 | B2 | 5/2013 | Davidson |
| D690,374 | S | 9/2013 | Lee |
| D692,513 | S | 10/2013 | Yigit |
| 8,561,334 | B2 | 10/2013 | Metzger |
| 8,713,835 | B1 | 5/2014 | Calvert |
| D707,783 | S | 6/2014 | Kielsmeier et al. |
| 8,752,318 | B2 | 6/2014 | Pulit, Jr. |
| 9,021,730 | B2 | 5/2015 | Gentilini et al. |
| D744,049 | S | 11/2015 | Chu |
| D748,219 | S | 1/2016 | Kielsmeier |
| D754,802 | S | 4/2016 | Martelli et al. |
| 9,303,936 | B2 | 4/2016 | Toner |
| D755,324 | S | 5/2016 | Martelli et al. |
| D755,907 | S | 5/2016 | Hu |
| D757,884 | S | 5/2016 | Kielsmeier |
| D758,519 | S | 6/2016 | Toner et al. |
| 9,395,129 | B2 | 7/2016 | Ball |
| 9,441,897 | B2 | 9/2016 | Mather |
| 9,546,831 | B2 | 1/2017 | Bandini et al. |
| 9,551,550 | B2 | 1/2017 | Wells |
| D783,111 | S | 4/2017 | Hillis |
| 9,664,471 | B1 | 5/2017 | Curry et al. |
| D791,262 | S | 7/2017 | Brown et al. |
| D803,341 | S | 11/2017 | Wolf |
| D808,487 | S | 1/2018 | Beville et al. |
| D810,223 | S | 2/2018 | Kielsmeier |
| D812,176 | S | 3/2018 | Kielsmeier |
| D814,593 | S | 4/2018 | O'Clair et al. |
| D814,596 | S | 4/2018 | Curry |
| D815,233 | S | 4/2018 | Toner et al. |
| 9,945,627 | B2 | 4/2018 | Porat |
| D823,969 | S | 7/2018 | Beville et al. |
| D828,881 | S | 9/2018 | Lee |
| D828,892 | S | 9/2018 | Kellgren |
| D830,480 | S | 10/2018 | Chu |
| 10,088,269 | B2 | 10/2018 | Sheets, Jr. et al. |
| D834,130 | S | 11/2018 | Schefter |
| D834,656 | S | 11/2018 | Chu |
| D838,333 | S | 1/2019 | Kielsmeier |
| 10,180,298 | B2 | 1/2019 | Noonan |
| D858,680 | S | 9/2019 | Thomele et al. |
| D860,336 | S | 9/2019 | Gong |
| 10,401,105 | B2 * | 9/2019 | Dowling ..... F41A 9/71 |
| 10,480,880 | B2 | 11/2019 | Thomele |
| 10,962,315 | B2 | 3/2021 | Thomele et al. |
| 2001/0037596 | A1 | 11/2001 | Salvitti |
| 2002/0029506 | A1 | 3/2002 | Wollmann |
| 2008/0028661 | A1 | 2/2008 | Bubits |
| 2012/0066950 | A1 | 3/2012 | Davidson |
| 2013/0227878 | A1 | 9/2013 | Rendulic |
| 2015/0192377 | A1 | 7/2015 | Larson, Jr. |
| 2015/0276339 | A1 | 10/2015 | Shreve |
| 2017/0146309 | A1 | 5/2017 | Biran |
| 2017/0146310 | A1 | 5/2017 | Biran |
| 2017/0184359 | A1 | 6/2017 | Porat |
| 2018/0058785 | A1 | 3/2018 | Hefer et al. |
| 2018/0347929 | A1 | 12/2018 | Hsu et al. |
| 2019/0195584 | A1 | 6/2019 | Thomele et al. |
| 2020/0056852 | A1 | 2/2020 | Thomele et al. |
| 2020/0208929 | A1 * | 7/2020 | Corso ..... F41A 9/71 |
| 2020/0240729 | A1 | 7/2020 | Bubits |

FOREIGN PATENT DOCUMENTS

| | | | |
|---|---|---|---|
| WO | WO-2015023243 A1 * | 2/2015 | ..... F41A 9/69 |
| WO | WO-2018005290 A1 * | 1/2018 | ..... F41A 9/64 |

OTHER PUBLICATIONS

Sig Sauer, Inc., P229 10rd .40 Auto, 357Sig Magazine, available at https://www.sigsauer.com/store/p229-10rd-40-auto-357sig-magazine.html> (2019).

GoOutdoorGear.com, Ruger American Pistol Magazine 10 Round 9mm Luger Mag (90514), available at https://www.gooutdoorgear.com/ruger-american-pistol-magazine-10-round-9mm-luger-mag-90514/736676905140/> (2019).

Beretta USA, Beretta APX Magazine 9mm 21 Rds. Unpackaged, available at https://www.berettausa.com/en/us/apx-9mm-mag-21-rds-bulk/jmapx219bulk/> (2019).

Sturm Ruger & Co., Instruction Manual for Ruger American Pistol Pro Model Parts List, pp. 34-37 (2016).

Sturm, Ruger & Co., Inc., "Instruction Manual for Ruger American Pistol, Standard Model" (2016).

Sig Sauer, Inc., "P365, Everyday Carry Size with Unprecedented 10+1 Full Size Capacity", https://www.sigsauer.com/products/firearms/pistols/p365/ (Jan. 10, 2018).

Sig Sauer, Inc., 2016 Product Catalog (2016).

Heckler & Koch, HK WebShop, HK-P30/VP9 10RD Magazine, SKU# 229750S, available at https://us.hkwebshop.com/hkstorefront/hk/en/Handgun-Parts/Magazines/P30-VP9-10rd-Magazine/p/229750S (accessed May 1, 2020).

Heckler & Koch, HK-P30SK Handgun, https://hk-usa.com/hk-models/p30sk/ (accessed May 1, 2020).

Heckler & Koch, HK-P30SK-Operators-Manual, Heckler & Koch (May 2015).

Botach.com, HK-USP 45 ACP Magazine, https://botach.com/hk-usp-45-acp-12rd-w-base-magazines/ (accessed May 1, 2020).

GunMagWarehouse.com, HK-USP-9 9 mm 15-Round Polymer Magazine, https://gunmagwarehouse.com/hk-usp-9-9mm-15-round-polymer-magazine.html (accessed May 1, 2020).

Sig Sauer, Sig Sauer Pro Magazine for SP2009, SP2022, 9mm Luger Steel Matte, (accessed May 1, 2020).

Sig Sauer, P250 Handling & Safety Instructions, OM-P250-USA Ver. Jul. 7, 2001 (Jul. 7, 2001).

Midway USA, Sig Sauer P224 Magazine, 9mm Luger Steel Matte, available at https://www.midwayusa.com/product/2139442581 (accessed May 1, 2020).

PrimaryArms.com, Sig Sauer P250/320 Compact Magazine 9 mm—15 Round Handgun, available at https://www.primaryarms.com/sig-p250-320-compact-magazine-9mm-15-round (accessed May 1, 2020).

Sig Sauer, P320 Handgun and M17 Magazine 9 mm—15 Round (accessed May 1, 2020).

Gun Parts Supply, "Pre-'94 Ban Factory Sig Sauer P229 German 12rd 40 s&w magazine," available at https://www.gunpartssupply.com/pre-94-ban-factory-sig-sauer-p229-german-12rd-40-s-w-magazine.html) (1994).

Small Arms Defense Journal, "The Sig Sauer P229," available at http://www.sadefensejournal.com/wp/the-sig-sauer-p229/ (Sep. 19, 2014).

Aim Surplus, Used Sig Sauer P320/P250 Full Size .45 Auto 10rd Magazine, available at https://aimsurplus.com/used-sig-sauer-p320-p250-full-size-45-auto-10rd-magazine/#gallery (visited Jan. 11, 2021).

(56) References Cited

OTHER PUBLICATIONS

Midwest Gun Works, Sig Sauer P250 / P320 Compact .45 ACP 9 Round Magazine, available at https://www.midwestgunworks.com/page/mgwi/prod/MAG-MOD-C-45-9 (visited Jan. 11, 2021).
Sig Sauer, P250/P320 Compact 9rd .45 ACP Magazine, available at https://www.sigsauer.com/p250-p320-compact-9rd-45acp-magazine.html (last visited Jan. 11, 2021).
Smith and Wesson, 2016 Product Catalog (S&W0017) (2016).
Cascio, Pat, SurvivalBlog.com, Taurus TX22 (Jul. 8, 2019).
Taurus, Taurus TX22 22LR Magazine 16 Rounds, available at https://shoptaurus.com/products/taurus-tx22-22lr-magazine-16-rounds.html (visited Mar. 13, 2022).
Sigtalk.com, "bought a taurus tx-22 today", available at https://www.sigtalk.com/threads/bought-a-taurus-tx22-today.349910/ (visited Mar. 13, 2022).
Palmetto State Armory, Taurus TX22 22LR 16 Rounds, available at https://palmettostatearmory.com/taurus-x22-22lr-16-round-magazine-blued-358-0017-01.html (visited Mar. 22, 2022).

* cited by examiner

MAGAZINE FOR RIMMED AMMUNITION

FIELD OF THE DISCLOSURE

This disclosure relates to accessories and components for use with firearms. More particularly, the present disclosure relates to an ammunition magazine for rimmed cartridges and a baseplate for the magazine.

BACKGROUND

Semiautomatic firearms, including handguns and long guns, use a detachable box magazine to feed ammunition into the chamber. The box-type magazine typically has a magazine tube that holds ammunition in a stack with projectiles of the ammunition pointing forward. A baseplate closes the bottom end of the tube and the upper end of the tube defines feed lips. A follower advances the ammunition towards the feed lips at the upper end of the tube due to the force of a spring between the baseplate and the follower. The magazine tube may be straight or curved, depending on the type of ammunition and its shape when stacked.

SUMMARY

One aspect of the present disclosure is directed to a detachable box magazine for rimmed cartridges. Another aspect of the present disclosure is directed to a magazine assembly that includes a novel baseplate and magazine tube. Numerous embodiments and variations will be apparent in light of the present disclosure.

Figure 1:
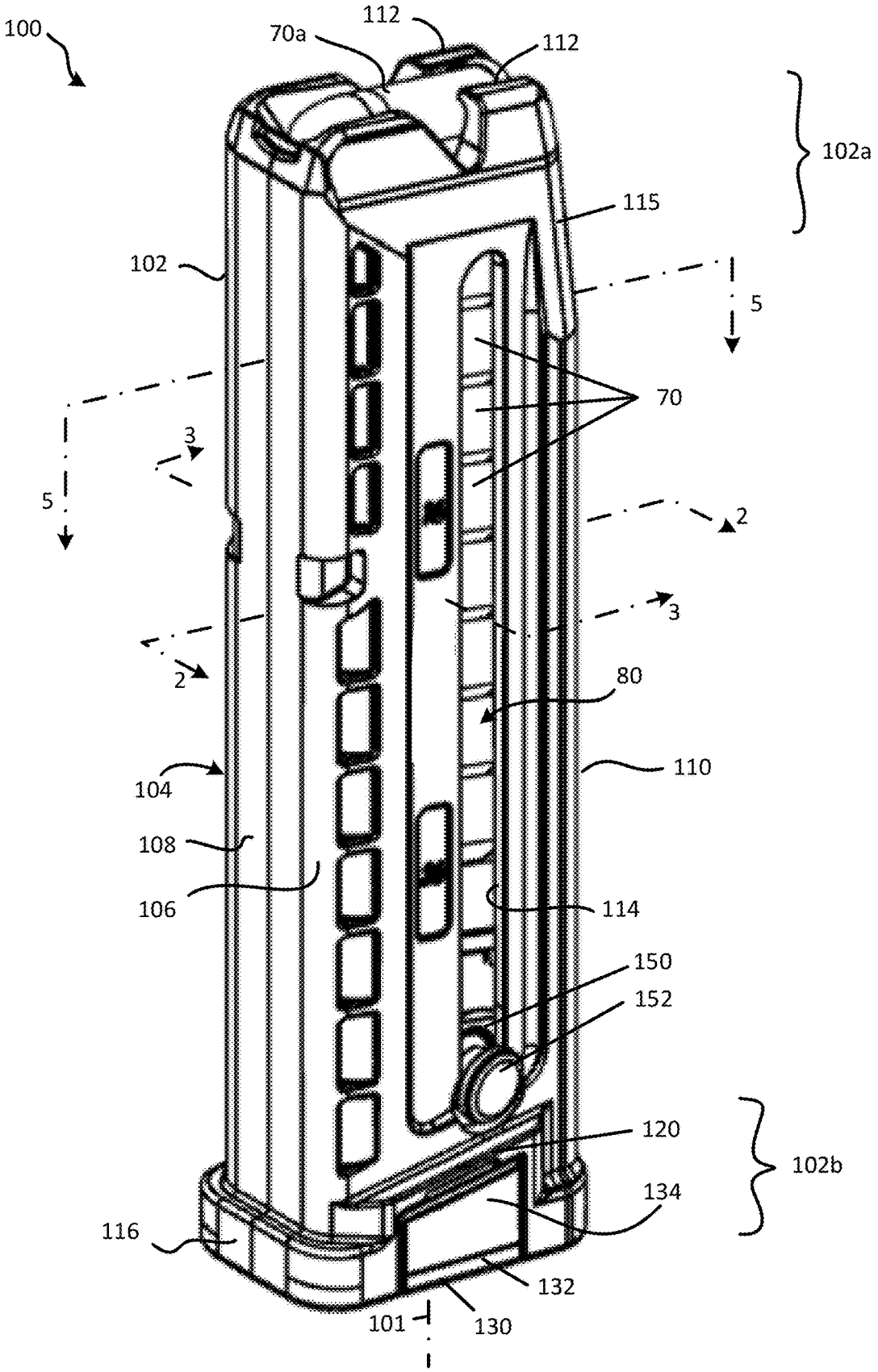
FIG. 1 illustrates a front and side perspective view of a magazine, in accordance with an embodiment of the present disclosure.

These and other features of the present embodiments will be better understood by reading the following detailed description, taken together with the Figures herein described. For purposes of clarity, not every component may be labeled in every drawing. Furthermore, as will be appreciated, the figures are not necessarily drawn to scale or intended to limit the present disclosure to the specific configurations shown. In short, the Figures are provided merely to show example structures.

DETAILED DESCRIPTION

Disclosed is a magazine for rimmed cartridges where the cartridges have a substantially parallel orientation when viewed from the side. Also disclosed is a magazine assembly that includes a baseplate and magazine tube, where the baseplate engages to a bottom end of the magazine tube, such as with a snap fit.

In one example embodiment, a magazine is configured for rimmed cartridges, such as .22LR ammunition. The magazine includes a magazine tube, a baseplate, a follower, and a spring, where the follower is biased toward the upper end of the tube by the spring. The inside faces of each lateral wall of the magazine tube include ribs that protrude inward and extend vertically along most of the length of the tube. A pair of opposed first ribs includes ribs on opposite sidewalls closer to the front of the magazine tube, where the first ribs are aligned and spaced apart laterally by a first distance. A pair of second ribs includes ribs extending inward from opposite sidewalls near the rear of the magazine tube, where the second ribs are aligned and spaced apart laterally by a second distance that is greater than the first distance. The ribs are sized and positioned to result in the cartridges stacking in a nominally parallel orientation when viewed from the side. When the magazine is loaded to capacity with ammunition, some cartridges in the magazine are arranged in two offset columns with axes of cartridges in adjacent columns generally converging when moving in a forward direction.

In another example, a magazine assembly includes a magazine tube and a baseplate. The baseplate is configured to attach to the base of the tube using a snap fit. In one such embodiment, the baseplate includes a pair of arms or tabs that extend upward from the plate of the baseplate. Each arm includes a hook or catch at its upper end. When the baseplate is advanced onto the lower end of the magazine tube along the tube axis, the arms are temporarily deflected outward and then snap into place with the catches occupying a recess defined in the surface of the magazine tube. For example, opposite lateral sides or the front and back of the magazine tube can define recesses to engage the catches. The baseplate may further define a recess useful to seat the magazine spring. Advantageously, such a design eliminates the need for a separate spring plate or retaining structure. Also, in some embodiments the baseplate can be recessed into the base and sides of the magazine tube when installed so that it is resistant to unintended disassembly, such as when the magazine is dropped.

General Overview

The baseplate of a magazine assembly is often installed onto the magazine tube by sliding engagement with flanges at the lower end of the magazine tube. To prevent the baseplate from inadvertently sliding off of the tube, an additional plate (e.g., a spring plate) abuts the top surface of the baseplate and includes a protrusion that extends downward and into the baseplate. When installed into the tube, this interface between the spring plate and baseplate prevents removal of the baseplate due to the spring plate blocking the baseplate from sliding off of the flanges. This engagement between the spring plate and baseplate is one type of retention mechanism for a magazine baseplate.

To remove the baseplate, the user presses the post upward into the tube to disengage the spring plate from the baseplate, usually with a punch or similar tool. This action allows the baseplate to slide off of the flanged lower end of the tube. A challenge with such an assembly is that the sliding movement of the baseplate is transverse to the force of the magazine spring. As such, efforts to control removal of the baseplate can result in the spring unexpectedly springing from the tube when the baseplate is removed. Similarly, when assembling the magazine, the spring plate must be pushed into the tube against the force of the spring while trying to slide the baseplate over the flanged end of the tube.

In light of these challenges, it would desirable to simplify the magazine assembly, such as eliminating the need for a spring plate. It would also be desirable to have a magazine assembly that is easier to assemble, such as one where the baseplate is installed in a direction consistent with the spring force. Therefore, a need exists for improvements to a baseplate and magazine assembly. The present disclosure addresses this need and others by providing a magazine assembly that includes a baseplate configured to snap to the bottom of the magazine tube. In some such embodiments, the baseplate eliminates the need for a separate spring plate or for an interlocking arrangement of spring plate and base plate to retain the baseplate on the magazine tube.

Magazines for pistol ammunition (e.g., 9 mm, 45 ACP) are configured to retain the ammunition in a stack within the magazine tube. The ammunition may be arranged in a single stack or an offset double stack. The bottom-most cartridge contacts a follower, which is biased toward the feed lips by a spring between the baseplate and the follower. In many cases, the ammunition is "rimless" where the head of the cartridge has a rim that does not extend beyond the diameter of the casing body. Due to behaving like a cylinder, rimless ammunition stacks in a column with the cartridges in parallel and with casings of adjacent cartridges abutting one another along a majority of the case length. Due to the shape of the stack, the magazine tube is most often straight.

In contrast, rimmed ammunition includes a flanged rim at the head of the cartridge that extends beyond the diameter of the casing body. Examples of rimmed ammunition include .22 LR, .17 HMR, .38 Special, and some shotgun cartridges. Some rimmed ammunition (e.g., .22 LR) is referred to as "rimfire" ammunition due to the location and type of primer in the rim. The rim of rimmed cartridges is used to retain the cartridge in the chamber with proper head spacing. When stacked, however, the larger diameter of the rim causes the cartridges to stack in a curved arrangement, as viewed from the side, due to the difference in size between the rim and the casing body. Accordingly, the magazine tube is often curved to accommodate the curvature of the ammunition stack and sometimes referred to as a "banana magazine."

One challenge is that the orientation of the central axis through the bottom cartridge changes as ammunition is depleted from the magazine. For example, the bottom-most cartridge in a banana magazine filled to capacity may be oriented at roughly 45° with respect to the bore axis while the top-most cartridge is oriented generally parallel to the bore axis. As ammunition is depleted, the follower moves along the curved tube with the top surface of the follower oriented with the cartridge above it.

A curved magazine has an increased propensity to result in feeding failures due to the block-shaped follower not moving smoothly through the curved tube. Additionally, the magazine spring in a curved magazine is often coiled along a linear axis, but when installed into a curved magazine tube results in an increased likelihood of a jam.

One approach to address challenges associated with rimfire magazines has been to stack the projectiles of the ammunition in a single column while skewing the heads in opposite directions. Although the heads have alternating orientations, such design results in a single, crisscrossed stack of ammunition, particularly as viewed from the front. Such design has reduced capacity since the magazine effectively is configured as a single stack magazine. Despite improvements in magazine design, many challenges still exist.

To address these challenges, the present disclosure provides a magazine for rimmed cartridges retained in a double stack arrangement, and where cartridges are substantially parallel as viewed from the side.

As will be appreciated in light of the present disclosure, and in accordance with some embodiments, ammunition magazines configured as described herein can be used in handguns or long guns alike. Further, concepts of the present disclosure can be applied to magazines for pistol ammunition, rimfire ammunition, rifle ammunition, and shotgun ammunition. In accordance with some example embodiments, a magazine configured as described herein can be utilized with a semiautomatic handgun chambered in .22 LR or other suitable ammunition. In accordance with other embodiments, a snap-fit base plate can be used with magazines for rimmed or rimless ammunition.

As discussed herein, terms referencing direction, such as upward, downward, vertical, horizontal, left, right, front, back, etc., are used for convenience to describe embodiments of a magazine in an upright orientation. Embodiments according to the present disclosure are not limited by these directional references and it is contemplated that magazines of the present disclosure could be used in any orientation.

It should also be noted that certain terminology is used herein for consistency and ease of understanding the present disclosure; however, the present disclosure is not limited to that specific terminology and alternate terms can be used to refer to the magazine and its components. For example, the disclosed magazine can alternately be referred to as a box magazine, an ammunition magazine, or other terms. Similarly, the disclosed floorplate can alternately be referred to, for example, as a bottom plate, a butt plate, a base plate, a magazine bottom, or other terms. As will be further appreciated, the particular configuration (e.g., materials, dimensions, etc.) of a magazine and its components configured as described herein may be varied, for example, depending on the intended use, type of ammunition to be retained, and firearm in which it will be used. Numerous configurations will be apparent in light of this disclosure.

Example Embodiments

FIG. 1 illustrates a right and front perspective view of a magazine 100 according to an embodiment of the present disclosure. The magazine 100 includes a magazine tube 102 with opposed sidewalls 104, 106, a front wall 108, and a rear wall 110, where the magazine tube 102 generally has a rectangular or trapezoidal cross-sectional shape. The magazine tube 102 extends along a magazine tube axis 101. A top end portion 102*a* of the magazine tube 102 tapers to retain a single cartridge between feed lips 112 that are configured to engage the top-most cartridge 70*a* and to guide feeding of the top-most cartridge 70*a* into the chamber of the firearm. In this example, the rear margins 115 of sidewalls 104, 106 have a linear taper along the top end portion 102*a* substantially to the feed lips 112. The lower end portion 102*b* has a flange 116 that protrudes outward and extends around the base of the magazine tube 102. Part of the flange 116 along sidewalls 104, 106 defines a recess 120 sized to receive and engage tabs 134 of a baseplate 130. In some embodiment, the flange 116 can be configured to abut the end of the magazine well of the firearm (e.g., end of the grip portion) when the magazine 100 is seated in the magazine well.

The baseplate 130 is attached to a lower end portion 102*b* of the magazine tube with tabs 134 extending axially along the lower end portion 102*b* of the magazine tube 102. The baseplate 130 includes a base 132 that is generally planar, and tabs 134 that extend upward from opposite sides of the base 132. Although shown as extending up from opposite lateral sides of the base 132, the tabs 134 could alternately extend up from the front and back of the base 132. Each tab 134 is configured to engage a recess 120 in the magazine tube 102, such as a recess in the flange 116, sidewall 104, 106, front tube wall 108, and/or rear tube wall 110. The catch 136 and recess 120 provide a snap fit. For example, a top end of each tab 134 includes a catch 136 (shown in FIG. 3) that is received in the recess 120. The baseplate 130 can be made of a flexible and resilient material that enables a snap fit with the lower end portion 102*b* of the magazine tube 102. For example, the baseplate 130 can be made of a polymeric material.

A follower 150 is retained in the magazine tube 102 between the baseplate 130 and the feed lips 112 and is biased towards the feed lips 112 by a magazine spring 160. When loaded with ammunition, the follower 150 is between the baseplate 130 and the stack 80 of one or more rimmed cartridges 70. The follower 150 optionally includes one or more posts 152 that protrude from each side of the follower 150 through elongated openings 114 that extend vertically along sidewalls 104, 106 of the magazine tube 102. The posts 152 are shown as being cylindrical; however, other geometries can be used. When the follower 150 rises to the top of the magazine 100 when the magazine is empty, the post(s) 152 lifts the slide catch lever so that the slide is retained in slidelock. Additionally, the user can use the enlarged ends 153 to pull down the follower 150 when loading to facilitate loading the magazine 100.

In this example, the magazine 100 is shown loaded to capacity with rimmed cartridges 70. As discussed below in more detail, the stack 80 includes two offset columns of rimmed cartridges 70 when loaded to capacity. As can be seen from a side of the magazine 100, vertically adjacent cartridges 70 in each column are arranged in a substantially parallel orientation in the magazine tube 102.

Figure 2A:
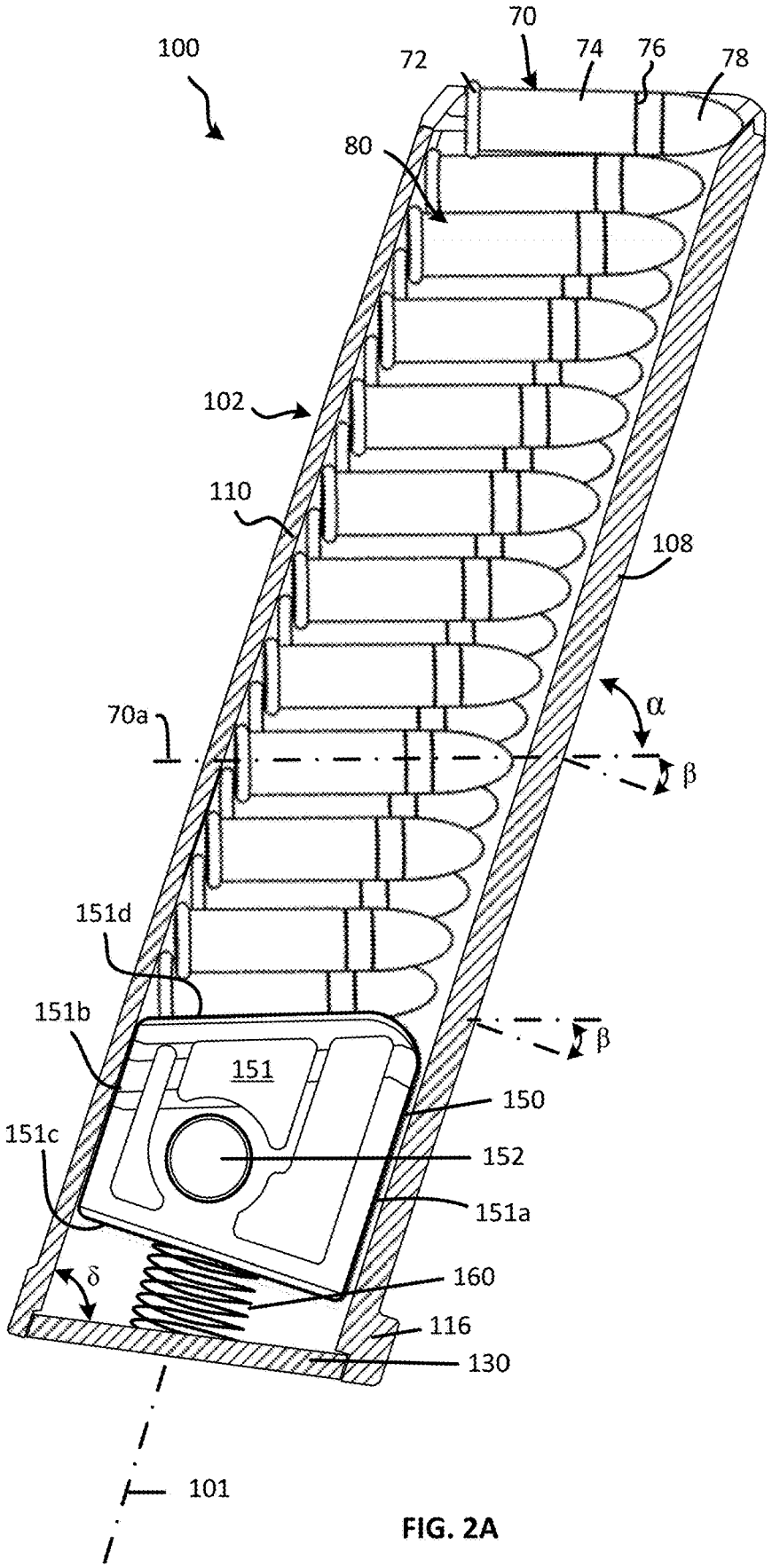
FIGS. 2A and 2B illustrate side views of a magazine in different orientations and loaded with rimmed cartridges, where the magazine tube and baseplate illustrated in cross section as viewed along line 2-2 of FIG. 1, in accordance with an embodiment of the present disclosure.
Figure 2B:
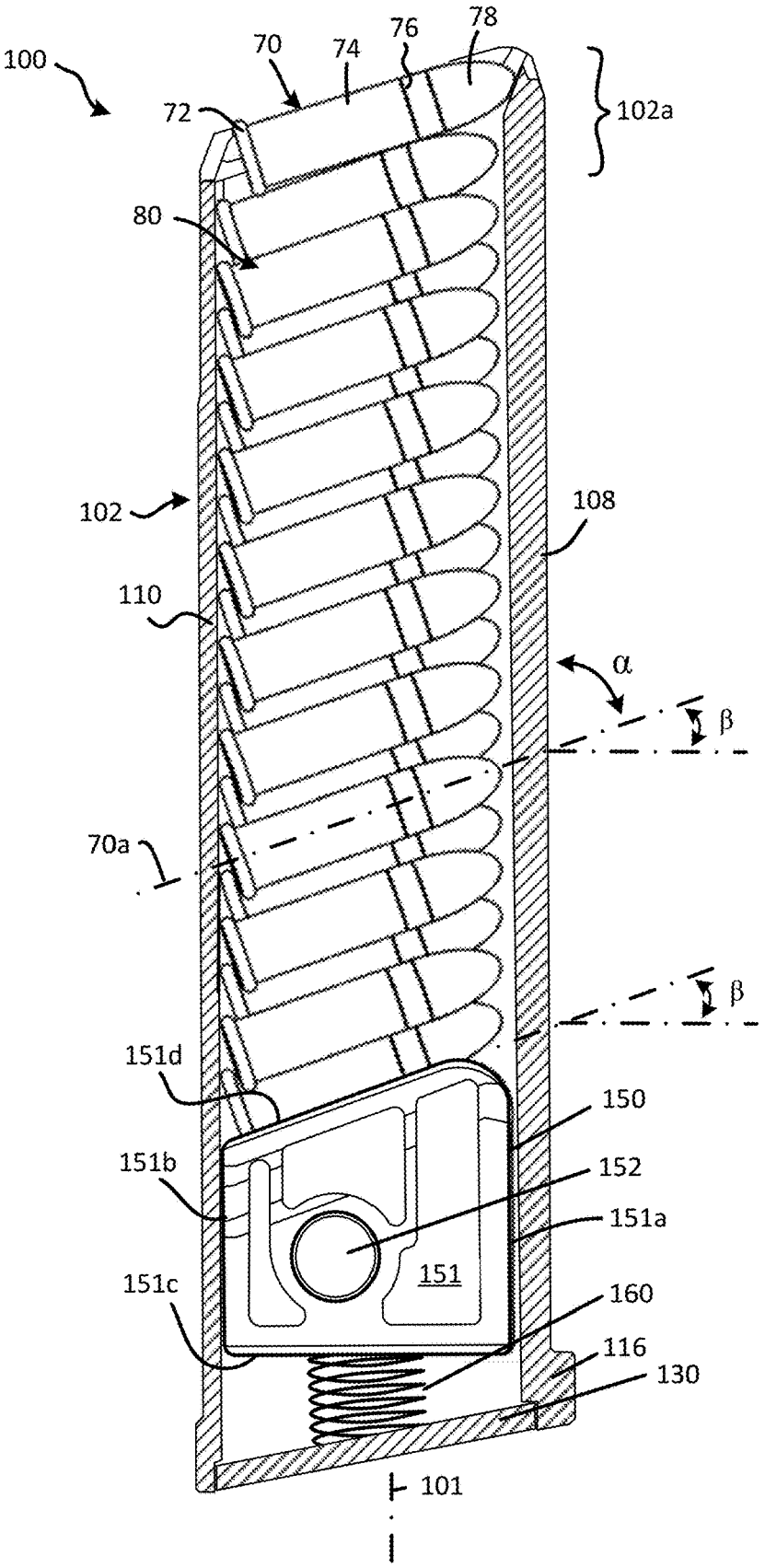

Referring now to FIGS. 2A and 2B, side views show a magazine 100 loaded with rimmed cartridges 70, where the magazine tube 102 is sectioned along line 2-2 of FIG. 1 to more clearly show the stack 80 of ammunition, in accordance with an embodiment. In FIG. 2A, the magazine 100 is oriented so that the cartridges 70 extend along a horizontal axis. In FIG. 2B, the magazine 100 is oriented so that the magazine tube 102 extends along a vertical tube axis 101.

The follower 150 is retained in the magazine tube 102 below the stack 80 and is biased upward toward the feed lips 112 (shown in FIG. 3) by a magazine spring 160 between the follower 150 and the baseplate 130. Each cartridge 70 includes a case 74 with a rim 72 at one end and a mouth 76 at the opposite end, where a projectile 78 is retained in the mouth 76. The rim 72 has a greater diameter than the body of the case 74.

The stack 80 includes twenty cartridges 70 in this example, although the magazine 100 can be configured to hold other quantities of cartridges 70, including 10, 15, 18, 25, or 30, for example. The top end portion 102*a* of the magazine tube 102 tapers in lateral width towards the feed lips 112 (visible in FIG. 3) and contains the first two cartridges 70. In this side view, all of the cartridges 70 generally have a substantially parallel orientation with projectiles 78 aligned along the front wall 108 of the magazine tube 102. The rim 72 of each cartridge 70 is positioned forward of a rim 72 of a cartridge 70 below it, where a top of each rim 72 abuts or is closely adjacent to the rear wall 110 (e.g., within 2 mm). The front wall 108 and rear wall 110 of the magazine tube 102 are substantially parallel (e.g., ±1°) and extend upward from the baseplate 130. The base 132 of the baseplate 130 is received within the flange 116 and is substantially flush with or recessed into the bottom of the flange 116.

When the top of the magazine 100 and cartridges 70 are oriented horizontally, such as in FIG. 2A, the magazine tube 102 extends upward at an angle $\alpha$ of about 65-75°, or about 70° with respect to the horizontal. Similarly, when the front wall 108 and rear wall 110 of magazine tube 102 extend vertically, such as in FIG. 2B, the cartridges 70 are angled upward at a pitch angle $\theta$ of about 15-25°, including 18-22°, and about 20°, with respect to the horizontal. In this example, the baseplate defines an angle $\delta$ from 72-84°, such as about 78° with the tube axis 101, which is parallel to front wall 108 and rear wall 110. The magazine tube 102 can define a different value of angle $\delta$ with respect to the baseplate 130, including being perpendicular to the baseplate 130, or other angle $\delta$ as deemed suitable for the grip angle and other configurations of a particular handgun and magazine well, as will be appreciated.

The follower 150 includes a follower body 151 with a front side 151*a*, a rear side 151*b*, a bottom side 151*c*, and a top side 151*d*. The front and rear sides 151*a*, 151*b* are aligned with the respective front wall and rear wall 110 of the magazine tube 102. The bottom side 151*c* is oriented generally perpendicular to the front and rear sides 151*a*, 151*b*. The top side 151*d* is substantially parallel to the axes of the cartridges 70 and defines angle R with the front side 151*a* of about 20°. The magazine spring 160 is positioned between the baseplate 130 and the bottom side 151*c* of the follower 150. The baseplate 130 is received between the front wall 108 and rear wall 110 and is flush with or recessed into the bottom of the magazine tube 102.

Figure 3:
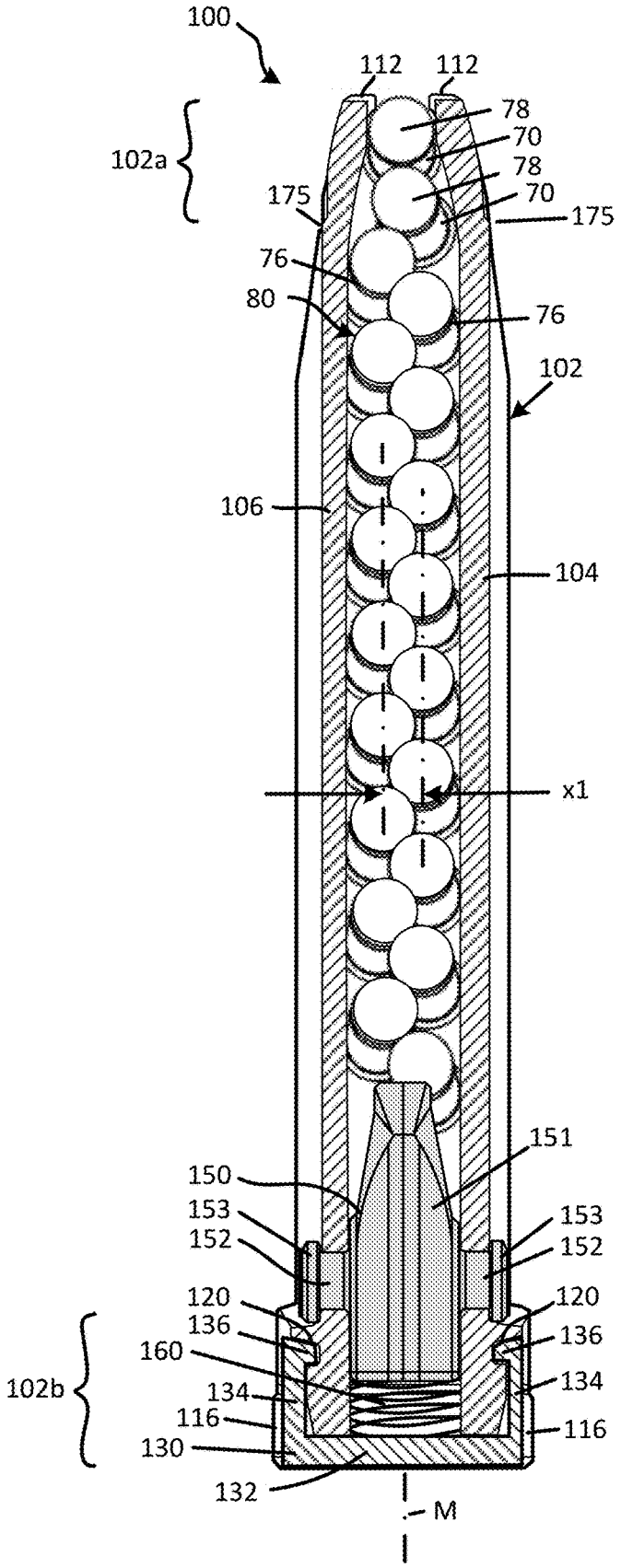
FIG. 3 illustrates a front view of a magazine loaded with rimmed cartridges and shows the magazine tube in cross section as viewed along line 3-3 of FIG. 1, in accordance with an embodiment of the present disclosure.

Referring now to FIG. 3, a front view shows a magazine 100 loaded with rimmed cartridges 70, where the magazine tube 102 is sectioned along line 3-3 of FIG. 1 to more clearly show the stack 80 of ammunition, in accordance with an embodiment. The stack 80 of cartridges 70 is received laterally between the sidewalls 104, 106, and vertically between the follower 105 and the feed lips 112. Projectiles 78 of the top two cartridges 70 are substantially aligned vertically in the top end portion 102*a* of the magazine 100 where the magazine 100 tapers to a reduced width in order to retain a single cartridge 70 below the feed lips 112. Below the top end portion 102*a*, or below a shoulder 175 on the magazine tube 102, the stack 80 includes cartridges 70 arranged in two offset columns. In some embodiments, the shoulder 175 identifies a location of the magazine tube 102 where it begins to taper upward from a double stack width to the feed lips 112, where the magazine 100 retains the top-most cartridge 70*a* of the stack 80 in a ready-to-feed position. The projectiles 78 of the cartridges 70 below the shoulder 175 are also in two offset columns where an imaginary line can be drawn through the centers of the projectiles 78 in each column as viewed from the front. The projectile centers of these .22LR cartridges 70 are spaced laterally by an amount x1 from 0.15-0.20 inch, or about 0.17 inch. Since this lateral spacing is less than a diameter of the projectiles 78 (typically 0.223 inch for .22 LR), the projectiles 78 overlap the median plane M to some extent. As discussed in more detail below, heads or rims 72 are laterally spaced from the median plane M by an amount that is greater than the lateral spacing from projectiles 78 to the median plane M. In this example, the result is that cartridges 70 below the shoulder 175 abut one another along the case 74 just behind the mouth 76 of the case 74.

The follower body 151 is centered between the sidewalls 104, 106 with a lower part of the follower body 151 snugly fit between the sidewalls 104, 106 of the lower end portion 102*b*. Note in the lower end portion 102*b* that the sidewalls 104, 106 have an increased thickness and define flange 116. The posts 152 extend through the sidewalls 104, 106 and each has an enlarged end 153 that travels along an outside surface of the sidewalls 104, 106. In some embodiments, the post 152 and end 153 stop on the lower end portion 102*b* of the magazine tube 102 when in the lowest position. Similar to as shown in FIGS. 2A-2B, the baseplate 130 is flush with or recessed into the bottom of the magazine tube 102. Tabs 134 extend up from the base 132 and include a catch 136 that is received in the recess 120 on each sidewall 104, 106.

Figure 4:
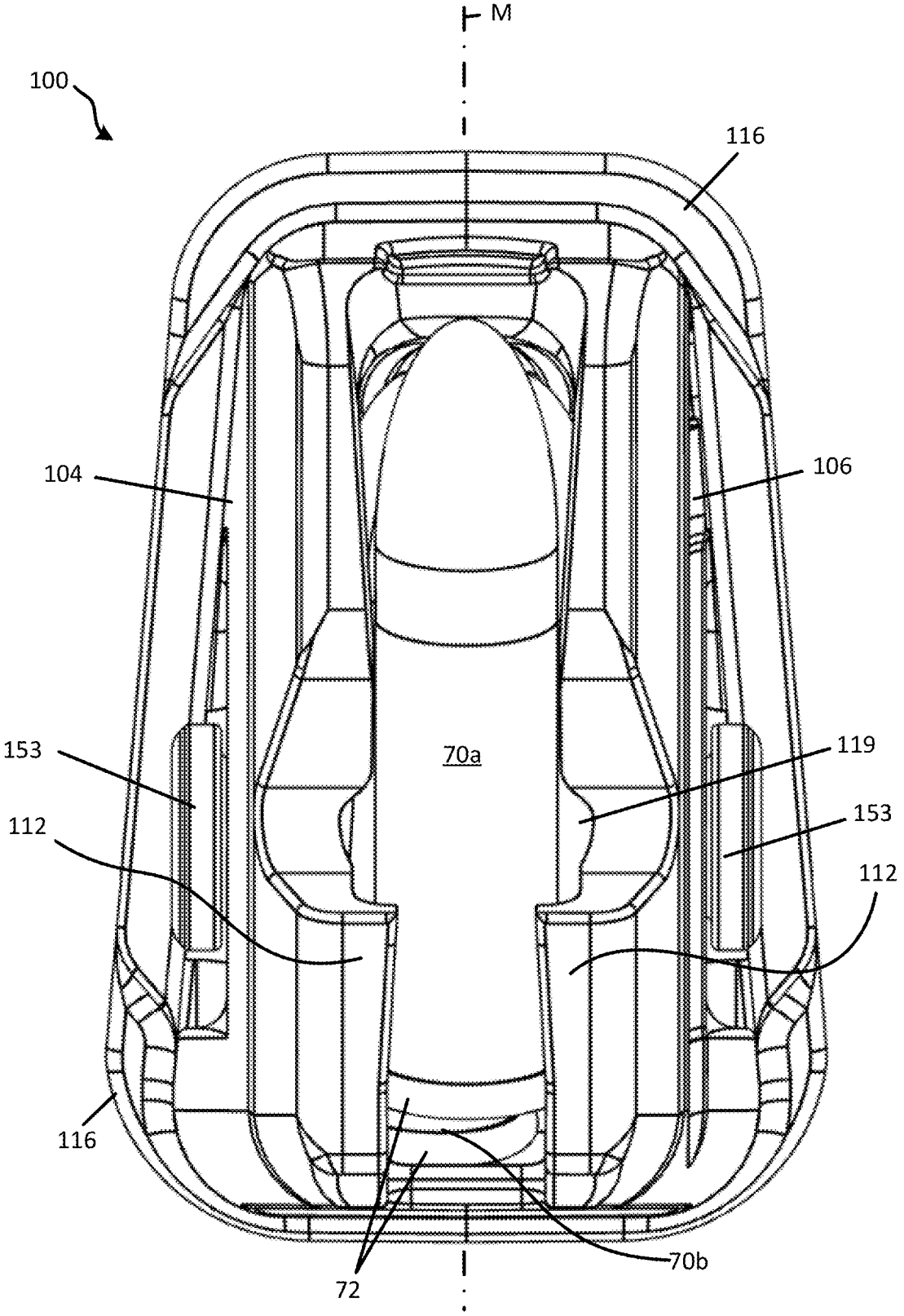
FIG. 4 illustrates a top view of a magazine loaded with rimmed cartridges, in accordance with an embodiment of the present disclosure.

FIG. 4 illustrates a top view of a magazine 100 loaded with cartridges 70, in accordance with an embodiment of the present disclosure. The top-most cartridge 70*a* is retained by feed lips 112 in a central position between sidewalls 104, 106. The feed lips 112 extend along a rear portion (e.g., about one-third) of the magazine opening. Forward of the feed lips 112 is an opening 119 that is enlarged to accommodate the rim 72 of a cartridge 70 during loading the magazine 100. In this example, the top-most cartridge 70*a* is centered on the median plane M. Part of the rim 72 of the second cartridge 70*b* can be seen and is positioned slightly off-center to the left. The magazine 100 has an overall profile of a trapezoid with rounded corners, where the front wall has a reduced width compared to the rear wall 110. The overall magazine geometry is symmetrical about the median plane M. The flange 116 can be seen protruding from other portions of the magazine 100, such as along a front of the magazine. Ends 153 of the posts 152 on the follower 150 are also shown.

Figure 5:
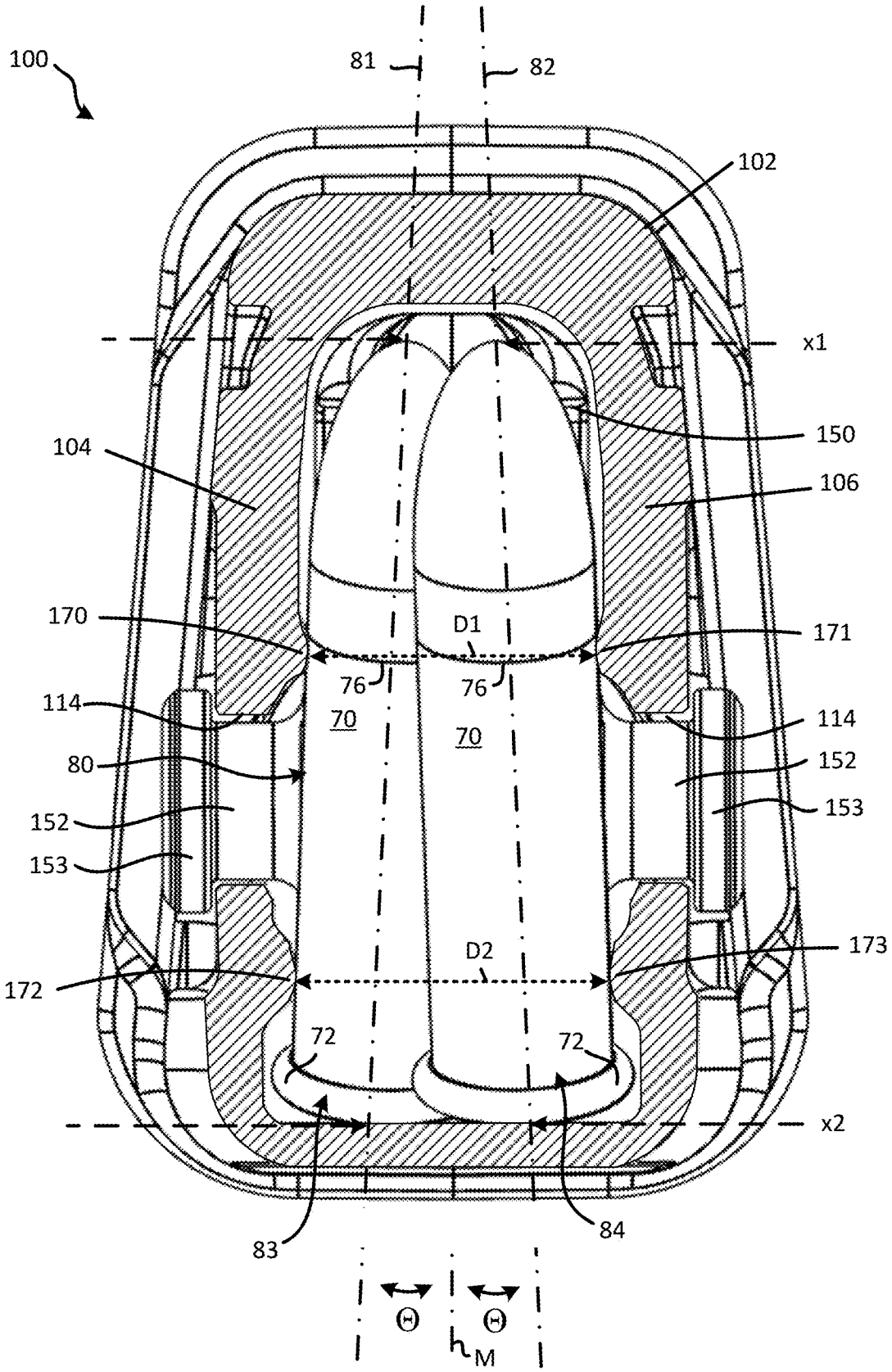
FIG. 5 illustrates a top view of part of a magazine loaded with rimmed cartridges where the magazine tube is shown in cross section according to line 5-5 of FIG. 1, in accordance with an embodiment of the present disclosure.

FIG. 5 illustrates a top view of a magazine 100 loaded with cartridges 70 and as viewed along line 5-5 of FIG. 1. In this example, the cartridges are arranged in two vertically offset columns, where axes through cartridges in each column are converging. In FIG. 5, axis 81 passes through the center of cartridges 70 in a left column 83, and axis 82 passes through centers of cartridges 70 in a right column 84. The median plane M through the magazine 100 is also shown. Each of axes 81, 82 defines a yaw angle Θ of about 2-5° in either direction (i.e., +2 to +5° or −2 to) −5°, from the median plane M, such as about +3° or −3°. The lateral distance x1 between centers of adjacent projectiles 78 is from 0.15-0.20 inch, or about 0.17 inch. The lateral distance x2 between centers of laterally adjacent rims 72 is from 0.25 to 0.35 inch, including about 0.30-0.33 inch and about 0.31 inch. In some embodiments, a ratio x1/x2 of lateral spacing between projectile centers to lateral spacing between rim centers is from 0.45 to 0.60, including about 0.48, 0.50, 0.53, 0.55, and 0.58.

The inside surfaces of sidewalls 104, 106 define ribs 170, 171, 172, 173 that extend inward. Each rib 170, 171, 172, 173 generally has a rounded profile, but a rectangular profile or other profile is also acceptable. Each rib 170, 171, 172, 173 is on the inside of the magazine tube 102 and extends along the magazine tube axis 101 for all or part of the height of the magazine tube 102. For example, ribs 170, 171, 172, 173 are present at least along portions of the magazine tube 102 where cartridges 70 are arranged or in two offset columns when the magazine 100 is filled to capacity, such as shown in FIG. 3. This region at least includes the sidewalls 104, 106 from a top of the follower 150 in its lowest position, to a shoulder 175 on the magazine 100 where it begins to taper from a double stack to a single cartridge.

A first left rib 170 and a first right rib 171 are arranged in an opposed relationship and extend inward toward one another from opposite sidewalls 104, 106, respectively. The first left rib 170 extends inward from a forward portion the left sidewall 104 and the first right rib 171 extends inward from a forward portion of the right sidewall 106. The first left rib 170 and the first right rib 171 are laterally spaced by a first distance D1. The first left rib 170 and first right rib 171 contact the case 74 of the cartridges 70 just behind the mouth 76.

A second left rib 172 and a second right rib 173 arranged in an opposed relationship, where the second left rib 172 extends inward from a rear portion of the left sidewall 104 and the second right rib 173 extends inward from a rear portion of the right sidewall 106. The second left rib 172 and the second right rib 173 are laterally spaced by a second distance D2 that is greater than the first distance D1. The second left rib 172 and the second right rib 173 contact the case 74 of the cartridges closer to the rim 72. Distances D1 and D2 can be selected to achieve the desired stack geometry, such as the location where adjacent cartridges 70 make contact, and/or to provide the lateral spacing x1, x2 discussed above for projectiles 78 and rims 72.

The openings 114 along sidewalls 104, 106 are also shown. A post 152 extends from each side of the follower 150 through each opening 114 to an enlarged end 153 that travels on an outside of the opening 114 along the magazine tube 102 when the follower 150 advances through the magazine tube 102. As noted above, the post(s) 152 can actuate the slide catch lever when the magazine 100 is empty and also can be used by the user to pull down the follower 150 to facilitate loading the magazine 100.

Figure 6:
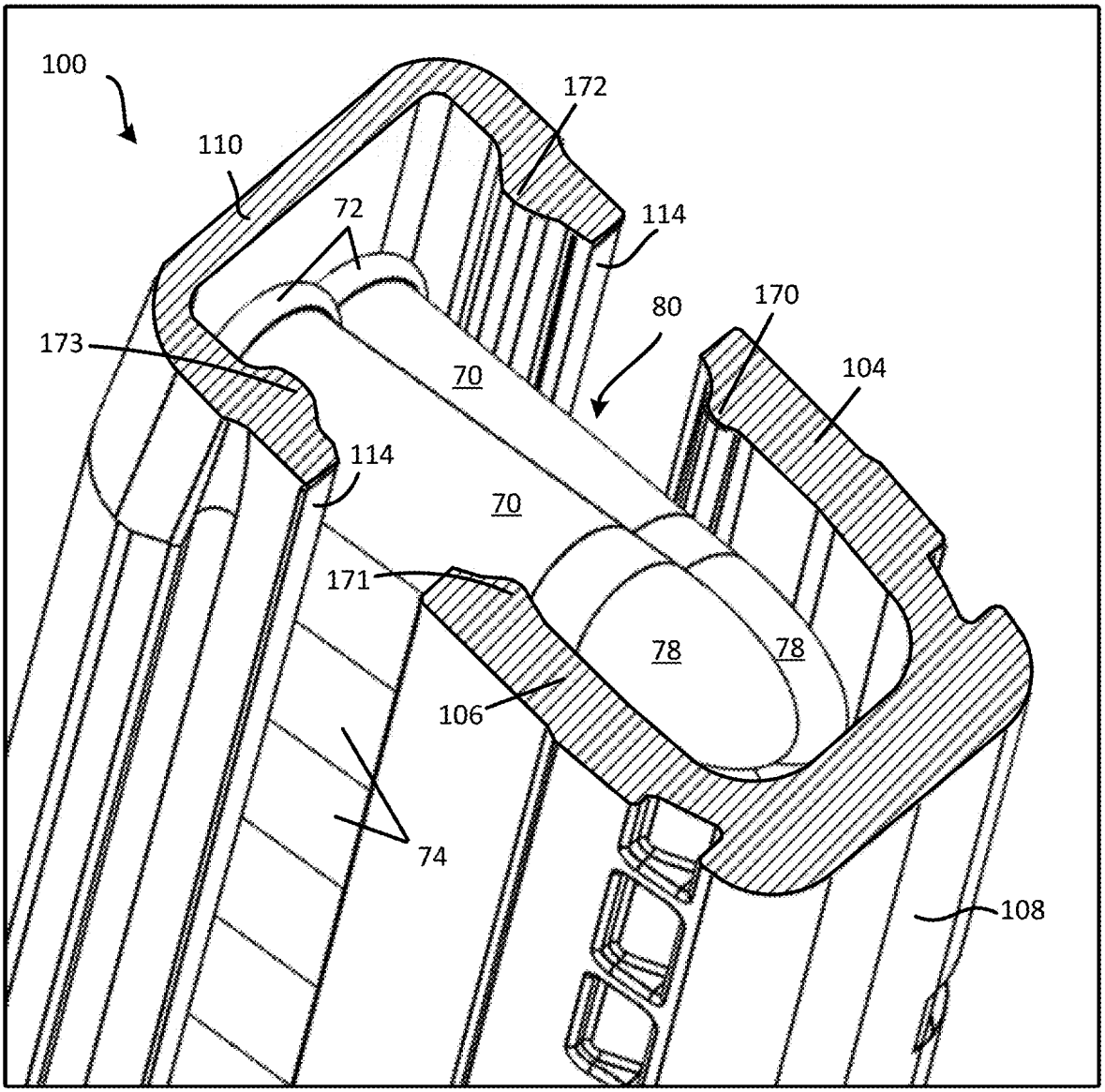
FIG. 6 illustrates a top, front, and side perspective view of the magazine and cartridges of FIG. 5, in accordance with an embodiment of the present disclosure.

FIG. 6 illustrates a top perspective view showing a magazine 100 sectioned according to line 5-5 of FIG. 1. Magazine 100 contains a stack 80 of cartridges 70 arranged in two offset columns with the rims 72 along the rear wall 110 and projectiles 78 are arranged in two offset columns along the front wall 108. Each sidewall 104, 106 defines vertically elongated opening 114. Each opening 114 is located between the first and second ribs on sidewalls 104, 106. Cases 74 can be seen through openings 114.

Figure 7:
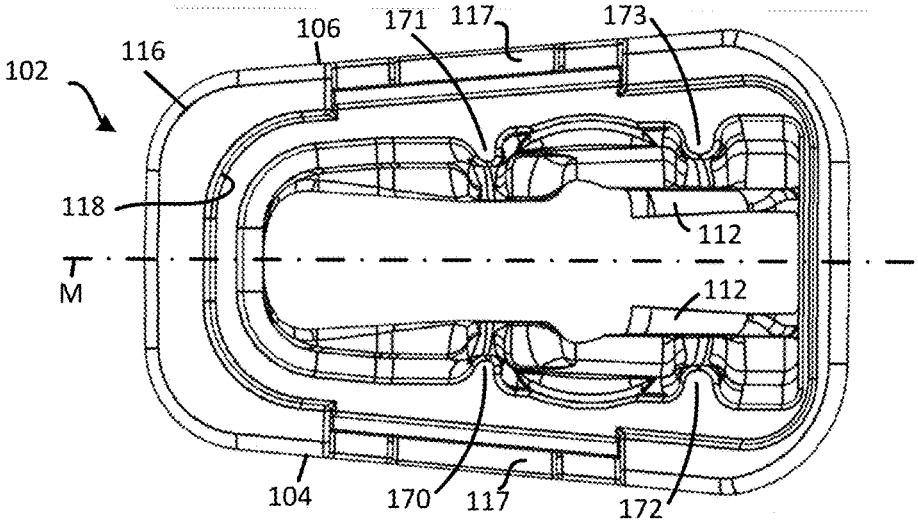
FIG. 7 illustrates a bottom view of a magazine tube, in accordance with an embodiment of the present disclosure.

FIG. 7 illustrates a bottom view of a magazine tube 102, in accordance with an embodiment of the present disclosure. Magazine tube 102 is generally symmetrical about median plane M. Flange 116 is interrupted along sidewalls 104, 106 by recesses 117 for tabs 134 of baseplate 130. The bottom of the flange 116 also defines a recessed region 118 that is sized and shaped to receive the base 132 of the baseplate 130. Feed lips 112 and ribs 170, 171, 172, and 173 are also shown.

Figure 8:
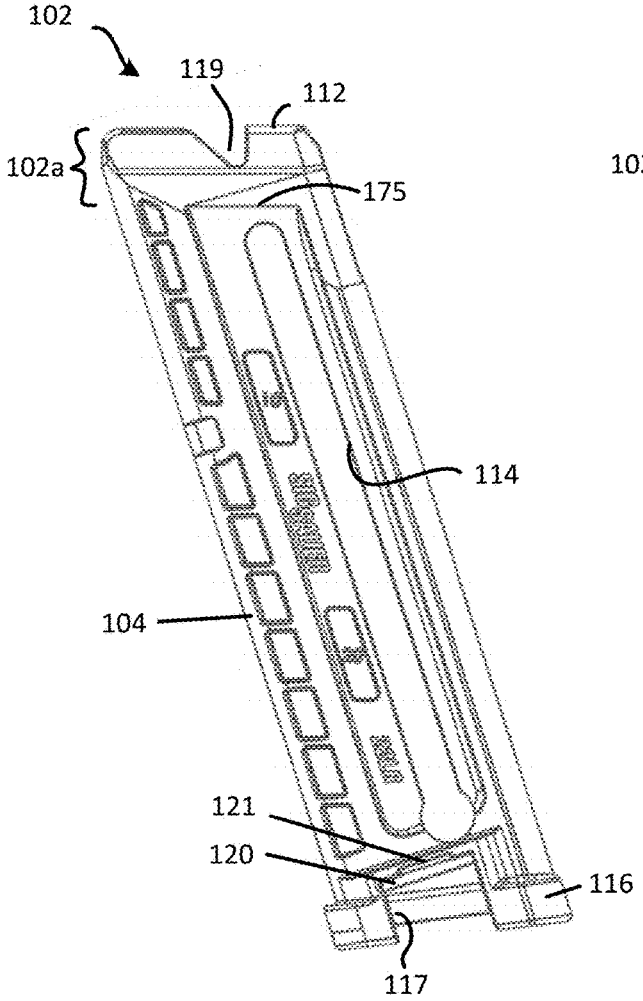
FIG. 8 illustrates a side view of a magazine tube, in accordance with an embodiment of the present disclosure.
Figure 9:
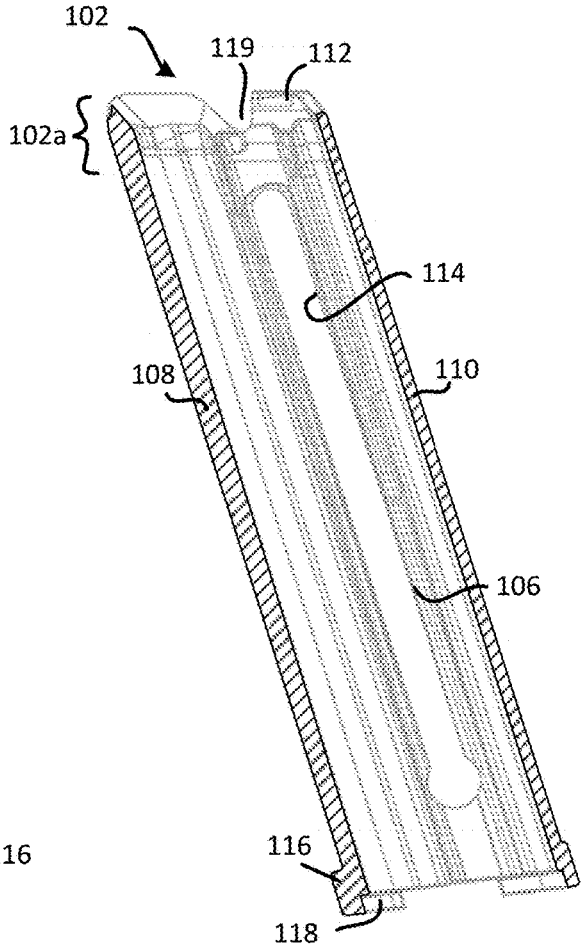
FIG. 9 illustrates a side and cross-sectional view of the magazine tube of FIG. 8, where the section is taken along a median plane, in accordance with an embodiment of the present disclosure.

FIG. 8 illustrates a side view of a magazine tube 102 and FIG. 9 illustrates a side cross-sectional view of a magazine tube 102 oriented as may be when installed in a magazine well so that cartridges in the magazine 100 are oriented horizontally, in accordance with some embodiments. Feed lips 112 and opening 119 for the rim 72 of the cartridge 70 are shown at the top end portion 102*a* of the magazine tube 102. The shoulder 175 can be seen on the outside of tube sidewall 104 and extends generally parallel to the top end of the magazine tube 102. The flange 116 defines recesses 117 to receive baseplate tabs 134 and further defines recesses 120 in sidewalls 104, 106 to engage catches 136 on the baseplate 130. Note in FIG. 8 that the recess 120 for the catch 136 has a notch 121 so that the user may disengage the catch 136 from the recess 120 to remove the baseplate 130, such as with a screwdriver or other tool. In FIG. 9, part of the recessed region 118 for the baseplate 130 is shown.

Figure 10:
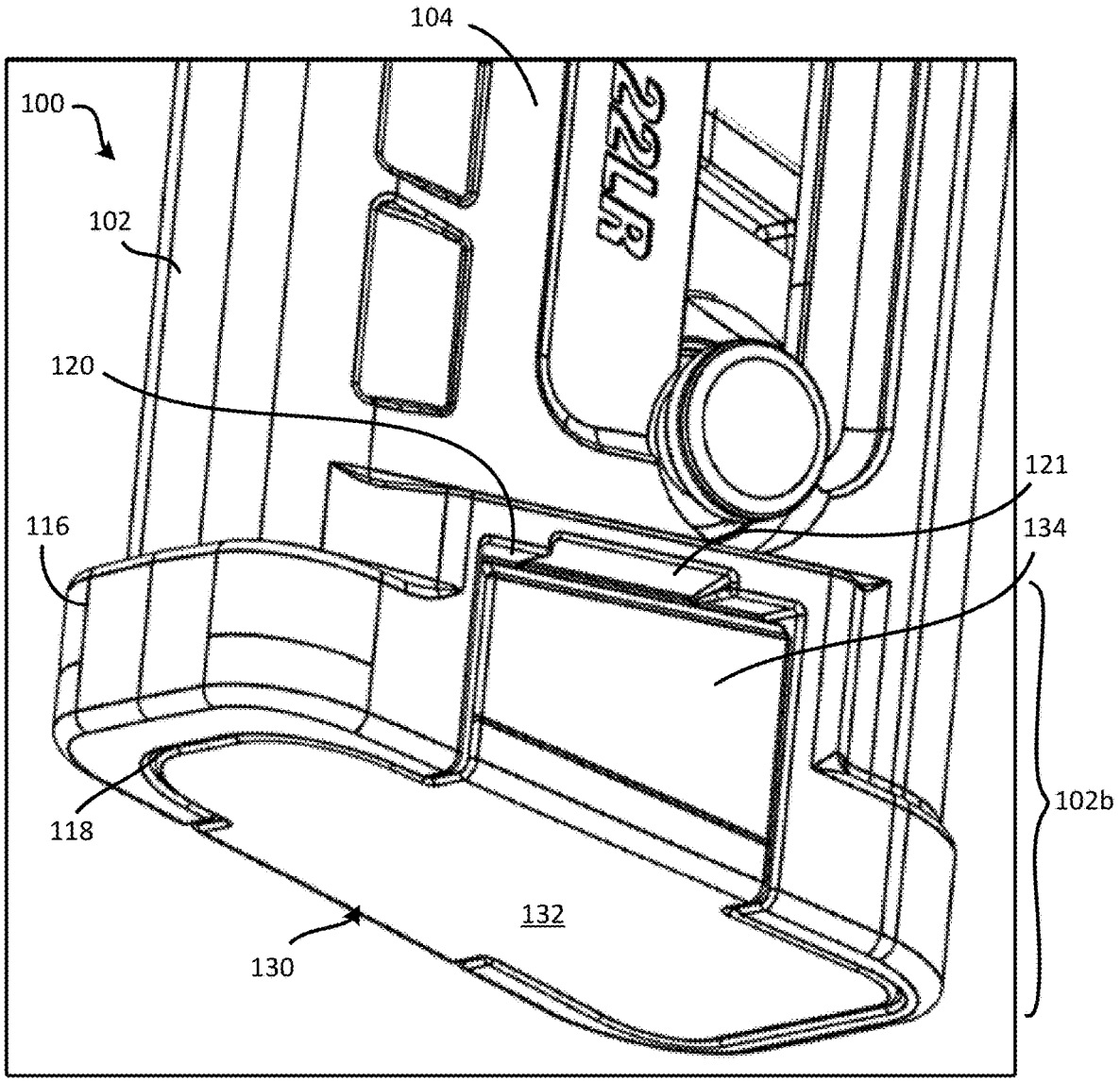
FIG. 10 illustrates a perspective view of a lower end portion of a magazine with an attached baseplate, in accordance with an embodiment of the present disclosure.

FIG. 10 illustrates a bottom perspective view showing the lower end portion 102*b* of a magazine 100 with installed baseplate 130, in accordance with an embodiment. The baseplate 130 includes tabs 134 that extend up from the base 132 and engage the sidewall 104 in the recess 120. As noted above, the recess 120 includes a notch 121 for disengaging the tab 134 from the recess 120. Note that the tab 134 is recessed into the side of the lower end portion 102*b* of the magazine tube 102 and the base 132 is recessed into the recessed region 118 defined by the flange 116, providing a flush fit between the baseplate 130 and magazine tube 102.

Figure 11:
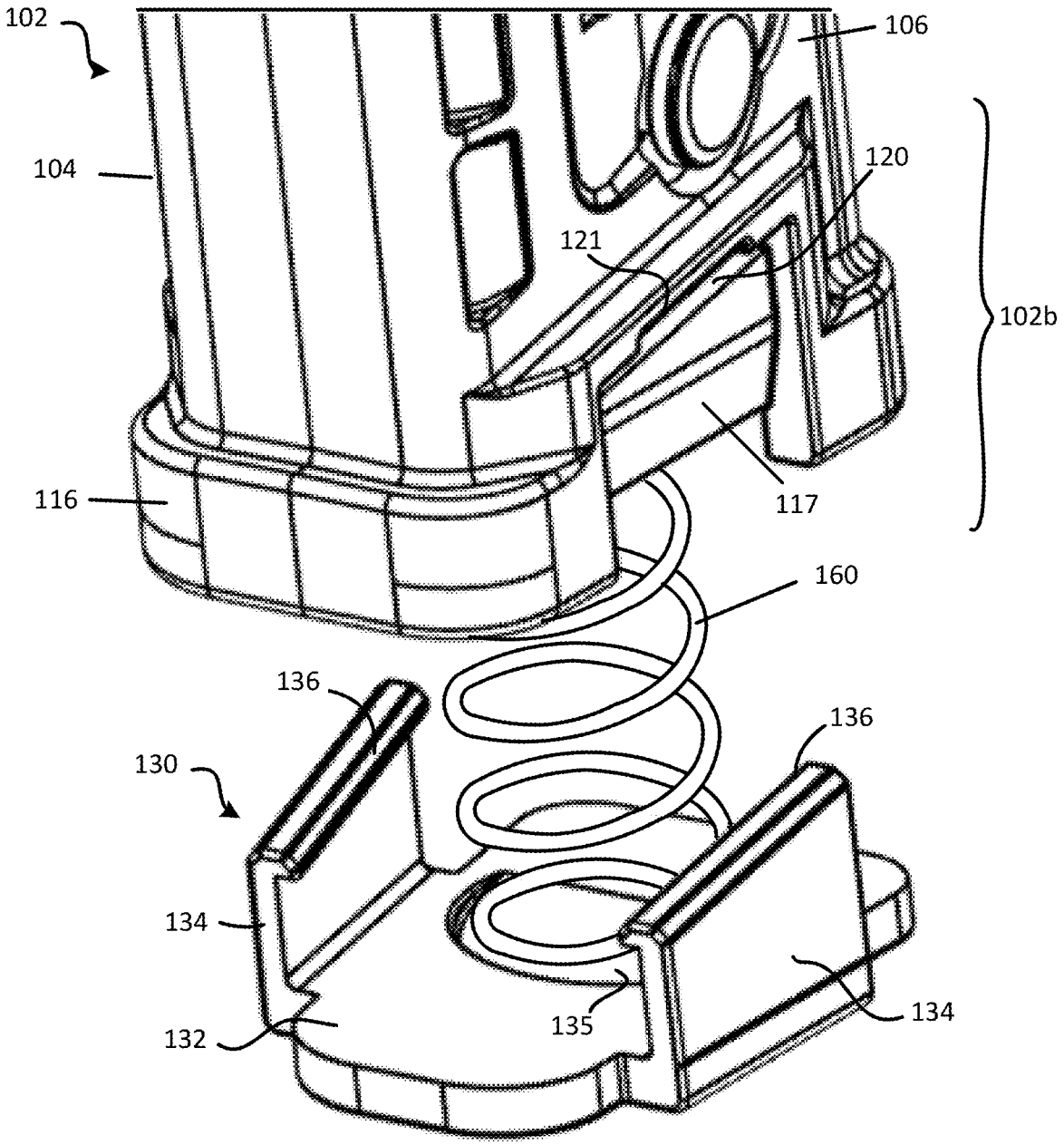
FIG. 11 illustrates a front perspective view of a lower end portion of a magazine in a disassembled form, in accordance with an embodiment of the present disclosure.

FIG. 11 illustrates a front perspective view showing a lower end portion 102*b* of a magazine tube 102, a baseplate 130, and a magazine spring 160 in a disassembled state, in accordance with some embodiments. Here, the baseplate 130 is removed from the magazine tube 102. An end of the magazine spring 160 is received in a spring recess 135 in the top surface of the base 132 of the baseplate 130, ready for installation. The magazine spring 160 is shown as a helical coil spring, but other spring geometries are acceptable, including a spring with rectangular coils, oval coils, or a combination of oval and rectangular coils. The shape of the spring recess 135 can match the shape of the magazine spring 160, or it can deviate from the overall shape of the magazine spring 160. In this example, the spring recess 135 is generally semicircular for a spring of circular coil shape.

As discussed above, the baseplate 130 includes a base 132 of generally planar geometry. Tabs 134 extend upward from opposite sides of the base 132 and include a catch 136 at the upper end. When installed onto the lower end portion 102*b* of the magazine tube 102, each catch 136 is received in the corresponding recess 120 defined in the sidewall 104, 106 and each tab 134 is recessed into the recess 117 defined in the sidewall of the magazine tube 102.

To install the baseplate 130, the user can seat the end of the magazine spring 160 into the spring recess 135, then push the baseplate 130 onto the lower end portion 102*b* of the magazine tube 102 along the direction of the magazine spring 160 or magazine tube axis 101 (shown in FIGS. 2A-2B) until each catch 136 snaps into the corresponding recesses 120. To remove the baseplate 130, the user may disengage each catch 136 individually or at the same time using a tool, followed by sliding the baseplate 130 off the lower end portion 102*b* of the magazine tube 102 in an axial direction. In its installed state, such as shown in FIG. 10, the tabs 134 and base 132 are recessed into or are flush with the outer surfaces of the magazine tube 102, which reduces the likelihood of impact to the baseplate 130 in the event the magazine 100 is dropped on the ground. Instead, the flange 116 is likely to receive the impact. The installation and removal processes are simplified compared to existing magazines in that the baseplate 130 does not require the user to disengage a separate spring plate from the baseplate, such as one having an interlocking protrusion received in an opening of the baseplate. It also does not involve sliding the baseplate off of the magazine tube in a direction that is transverse to the spring force.

Further Example Embodiments

The following examples pertain to further embodiments, from which numerous permutations and configurations will be apparent.

Example 1 is a magazine for rimmed cartridges, the magazine comprising a magazine tube having a front tube wall, a rear tube wall, a left tube sidewall, and a right tube sidewall. A first left rib and a first right rib extend along an inside of the magazine tube in an opposed relationship, where the first left rib extends inward from a forward portion of the left tube sidewall and the first right rib extends inward from a forward portion of the right tube sidewall, and where the first left rib and the first right rib are laterally spaced by a first spacing. A second left rib and a second right rib extend along an inside of the magazine tube in an opposed relationship, where the second left rib extends inward from a rear portion of the left tube sidewall and the second right rib extends inward from a rear portion of the right tube sidewall, and where the second left rib and the second right rib are laterally spaced by a second spacing that is greater than the first spacing. When the magazine is filled to capacity with rimmed cartridges, the magazine includes a stack of rimmed cartridges arranged in two offset columns with projectiles of the rimmed cartridges laterally spaced from a median plane by a first distance and rims of the rimmed cartridges laterally spaced from the median plane by a second distance that is greater than the first distance.

Example 2 includes the subject matter of Example 1, where, when filled to capacity, projectiles of the rimmed cartridges are arranged in two offset columns along the front tube wall of the magazine tube.

Example 3 includes the subject matter of Example 1 or 2, where when filled to capacity, except for a top-most cartridge, each cartridge in the magazine contacts a next highest cartridge in the stack near a mouth of a cartridge casing of the next highest cartridge.

Example 4 includes the subject matter of Example 1 or 2, where when filled to capacity, except for a top-most cartridge, a projectile of each cartridge in the magazine contacts a casing of a next highest cartridge in the stack near a mouth of the cartridge casing of the next highest cartridge.

Example 5 includes the subject matter of any of Examples 1-4, where the rimmed cartridges have a parallel orientation as viewed from a side of the magazine.

Example 6 includes the subject matter of any of Examples 1-5, where the first left rib and the first right rib contact a forward portion of shell casings in the stack and the second left rib and the second right rib contact a rear portion of shell casings in the stack.

Example 7 includes the subject matter of Example 6, where the forward portion of the shell casings is adjacent a mouth of the shell casings and wherein the rear portion of the shell casings is adjacent the rim of the shell casings.

Example 8 includes the subject matter of any of Examples 1, where, when filled to capacity, except for a top-most cartridge, a rim of cartridges in the stack are offset in an alternating fashion to one side of the median plane.

Example 9 includes the subject matter of any of Examples 1-8, where, except for the top-most cartridge, each cartridge in the magazine is offset from the median plane by 2-4°.

Example 10 includes the subject matter of any of Examples 1-9, where the top-most cartridge is centered between the left tube sidewall and the right tube sidewall and is aligned along the median plane.

Example 11 includes the subject matter of any of Examples 1-10, where an axis through each cartridge in the magazine defines a pitch angle of between 15-25° with respect to a horizontal when the front wall of the magazine tube is oriented vertically.

Example 12 includes the subject matter of Example 11, where the pitch angle is from 18° to 22°.

Example 13 includes the subject matter of any of Examples 1-12, where an axis through each cartridge in the magazine, except for the top-most cartridge, defines a yaw angle of ±2-5° with respect to the median plane.

Example 14 includes the subject matter of Example 13, where the yaw angle is about +3° or about −3°.

Example 15 includes the subject matter of any of Examples 1-14 and further comprises a baseplate configured to attach to the magazine tube using a snap fit.

Example 16 is a magazine comprising a magazine tube extending along a magazine axis from a lower end portion to a top end portion defining feed lips, and a baseplate configured to attach to the lower end portion of the magazine tube using a snap fit.

Example 17 includes the subject matter of Example 16, where the baseplate comprises a base having a generally planar geometry, tabs extending up from opposite sides of the base, and a catch on an upper end of each of the tabs.

Example 18 includes the subject matter of Example 18, where the opposite sides of the base include a left side and a right side or a front side and a rear side.

Example 19 includes the subject matter of any of Examples 16-18, where a bottom end of the magazine tube defines a recessed region sized and configured to receive the base of the baseplate so that the base is recessed into or flush with the bottom end of the magazine tube.

Example 20 includes the subject matter of any of Examples 16-19, where the lower end portion of the magazine tube defines a recess sized and configured to receive each of the tabs of the baseplate so that the tab is recessed into or is flush with the lower end portion.

Example 21 includes the subject matter of any of Examples 16-20 and further comprises a follower received in the magazine tube and a magazine spring between the follower and the baseplate.

Example 22 includes the subject matter of Example 21, where the baseplate defines a recess for the magazine spring.

Example 23 includes the subject matter of any of Examples 16-22, where the magazine tube and baseplate are made of a polymeric material.

Example 24 includes the subject matter of any of Examples 16-23, where the magazine tube has a front tube wall, a rear tube wall, a left tube sidewall, and a right tube sidewall. A first left rib and a first right rib extending along an inside of the magazine tube in an opposed relationship, where the first left rib extends inward from a forward portion of the left tube sidewall and the first right rib extends inward from a forward portion of the right tube sidewall, and where the first left rib and the first right rib are laterally spaced by a first spacing. A second left rib and a second right rib extend along an inside of the magazine tube in an opposed relationship, where the second left rib extends inward from a rear portion of the left tube sidewall and the second right rib extends inward from a rear portion of the right tube sidewall, and where the second left rib and the second right rib are laterally spaced by a second spacing that is greater than the first spacing. When the magazine is filled to capacity with rimmed cartridges, the magazine includes a stack of rimmed cartridges arranged in two offset columns with projectiles of the rimmed cartridges laterally spaced from a median plane by a first distance and rims of the rimmed cartridges laterally spaced from the median plane by a second distance that is greater than the first distance.

Example 25 includes the subject matter of any of Examples 1-24, where the magazine is configured for use with a handgun.

Example 26 includes the subject matter of any of Examples 1-25, where the magazine is configured for rimfire ammunition.

The foregoing description of example embodiments has been presented for the purposes of illustration and description. It is not intended to be exhaustive or to limit the present disclosure to the precise forms disclosed. Many modifications and variations are possible in light of this disclosure. It is intended that the scope of the present disclosure be limited not by this detailed description, but rather by the claims appended hereto. Future-filed applications claiming priority to this application may claim the disclosed subject matter in a different manner and generally may include any set of one or more limitations as variously disclosed or otherwise demonstrated herein.

What is claimed is:

1. A magazine for rimmed cartridges, the magazine comprising:

a magazine tube extending linearly along a central axis from a bottom end to a top end, the magazine tube having a front tube wall, a rear tube wall, a left tube sidewall, and a right tube sidewall;

a first left rib and a first right rib extending along an inside of the magazine tube in an opposed relationship, wherein the first left rib extends inward from a forward portion of the left tube sidewall and the first right rib extends inward from a forward portion of the right tube sidewall, and wherein the first left rib and the first right rib are laterally spaced by a first spacing; and a second left rib and a second right rib extending along an inside of the magazine tube in an opposed relationship, wherein the second left rib extends inward from a rear portion of the left tube sidewall and the second right rib extends inward from a rear portion of the right tube sidewall, wherein the second left rib and the second right rib are laterally spaced by a second spacing that is greater than the first spacing;

wherein when the magazine is filled to capacity with rimmed cartridges, the magazine includes a stack of rimmed cartridges arranged in two offset columns with the rimmed cartridges in the two offset columns being directed inward towards a median plane, and wherein an axis through each of the rimmed cartridges extends upward at a pitch angle from 15° to 25° with respect to a horizontal when the front tube wall is oriented vertically.

2. The magazine of claim 1, wherein when filled to capacity, projectiles of the rimmed cartridges are arranged in two offset columns along the front tube wall of the magazine tube.

3. The magazine of claim 1, wherein when filled to capacity, except for a top-most cartridge, each cartridge in the magazine contacts an adjacent higher cartridge in the stack near a mouth of a cartridge casing of the adjacent higher cartridge.

4. The magazine of claim 1, wherein when filled to capacity, except for a top-most cartridge, a projectile of each cartridge in the magazine contacts a casing of an adjacent higher cartridge in the stack near a mouth of the cartridge casing of the adjacent higher cartridge.

5. The magazine of claim 1, wherein all of the rimmed cartridges have a parallel orientation as viewed from a side of the magazine.

6. The magazine of claim 1, wherein the first left rib and the first right rib contact shell casings adjacent a mouth of the shell casings in the stack and the second left rib and the second right rib contact a rear portion of shell casings in the stack.

7. The magazine of claim 6, wherein the rear portion of the shell casings is adjacent the rim of the shell casings.

8. The magazine of claim 1, wherein when filled to capacity, a rim of each of the rimmed cartridges is inclined to the rear tube wall.

9. The magazine of claim 1, wherein, except for the top-most cartridge, each cartridge in the magazine extends inward toward the median plane at a yaw angle from 2-4°.

10. The magazine of claim 1, wherein the top-most cartridge is centered between the left tube sidewall and the right tube sidewall and is aligned along a central median plane.

11. The magazine of claim 1, wherein the pitch angle is from 18° to 22°.

12. The magazine of claim 11, wherein the axis through each cartridge in the magazine defines a yaw angle in a range from 2° to 5° or from −2° to −5° with respect to the median plane.

13. The magazine of claim 12, where the yaw angle is about +3° or about −3°.

14. The magazine of claim 1, further comprising a baseplate configured to attach to the magazine tube using a snap fit, the baseplate having a base and tabs extending up from opposite sides of the base, wherein the tabs are configured to extend along an outside of the magazine tube.

15. A magazine comprising:

a magazine tube extending along a magazine axis from a lower end portion to a top end portion defining feed lips; and a baseplate configured to attach to be installed in a direction along the magazine axis onto the lower end portion of the magazine tube using a snap fit, the baseplate having a base and tabs extending up from opposite sides of the base and configured to extend along an outside of the lower end portion of the magazine and snap in to a recesses defined in a side of the magazine tube when the baseplate is installed on the magazine tube.

16. The magazine of claim 15, wherein the base of the baseplate has a planar geometry.

17. The magazine of claim 16, wherein a bottom end of the magazine tube defines a recessed region sized and configured to receive the base of the baseplate so that the base is recessed into or flush with the bottom end of the magazine tube.

18. The magazine of claim 15, wherein each side of the lower end portion define a recess sized and configured to receive one of the tabs of the baseplate so that each tab is recessed into or is flush with a side the outside surface of the lower end portion.

19. The magazine of claim 15, wherein the magazine tube has a front tube wall, a rear tube wall, a left tube sidewall, and a right tube sidewall and the magazine further comprising:

a first left rib and a first right rib extending along the magazine axis on an inside of the magazine tube in an opposed relationship, wherein the first left rib extends inward from a forward portion of the left tube sidewall and the first right rib extends inward from a forward portion of the right tube sidewall, and wherein the first left rib and the first right rib are laterally spaced by a first spacing; and a second left rib and a second right rib extending along the magazine axis on an inside of the magazine tube in an opposed relationship, wherein the second left rib extends inward from a rear portion of the left tube sidewall and the second right rib extends inward from a rear portion of the right tube sidewall, wherein the second left rib and the second right rib are laterally spaced by a second spacing that is greater than the first spacing;

wherein when the magazine is filled to capacity with rimmed cartridges, the magazine includes a stack of rimmed cartridges arranged in two offset columns with the rimmed cartridges in the two offset columns being directed inward towards a median plane.

20. The magazine of claim 19, wherein a longitudinal axis through each of the rimmed cartridges extends upward at a pitch angle from 15° to 25° with respect to a horizontal when the front tube wall is oriented vertically.

* * * * *